US008267546B2

(12) United States Patent
Reith et al.

(10) Patent No.: US 8,267,546 B2
(45) Date of Patent: Sep. 18, 2012

(54) FOIL MIRROR WITH BACK LIGHT

(76) Inventors: Gary Reith, Dobbs Ferry, NY (US); Dwayne Reith, Dobbs Ferry, NY (US)

( * ) Notice: Subject to any disclaimer, the term of this patent is extended or adjusted under 35 U.S.C. 154(b) by 511 days.

(21) Appl. No.: 12/462,970

(22) Filed: Aug. 12, 2009

(65) Prior Publication Data

US 2011/0038162 A1 Feb. 17, 2011

(51) Int. Cl.
*F21V 33/00* (2006.01)

(52) U.S. Cl. ..... 362/253; 362/234; 132/288

(58) Field of Classification Search ..... 362/253, 362/234; 132/288, 291
See application file for complete search history.

(56) References Cited

U.S. PATENT DOCUMENTS 5,997,149 A 12/1999 Chu
6,880,952 B2 4/2005 Kiraly et al.
7,202,613 B2 4/2007 Morgan et al.
D545,067 S 6/2007 Mischel, Jr.
D545,574 S 7/2007 Mischel, Jr.
7,303,309 B2 12/2007 Wu et al.
7,393,115 B2 * 7/2008 Tokushita et al. ..... 362/136
2006/0007701 A1 1/2006 Schoellmann et al.
2007/0195533 A1 8/2007 Wenger
2007/0291498 A1 12/2007 Covasala et al.
2008/0170309 A1 7/2008 Helenowski

* cited by examiner

*Primary Examiner* — Laura Tso
(74) *Attorney, Agent, or Firm* — Aziz M. Ahsan; Ahsan & Associates, PLLC

(57) ABSTRACT

The present invention relates generally to a foil mirror. More particularly, the invention encompasses a foil mirror with at least one back light. The present invention is also directed to a novel foil mirror having a mirror surface that has different reflective colors. The foil mirror is made of a flexible plastic material and is shatter-proof. The back light to the foil mirror is provided by a light source, such as, for example, an LED bulb, an incandescent light bulb, a fluorescent light bulb, to name a few.

20 Claims, 1 Drawing Sheet

FOIL MIRROR WITH BACK LIGHT

FIELD OF THE INVENTION

The present invention relates generally to a foil mirror. More particularly, the invention encompasses a foil mirror with at least one back light. The present invention is also directed to a novel foil mirror having a mirror surface that has different reflective colors. The foil mirror is made of a flexible plastic material and is shatter-proof. The back light to the foil mirror is provided by a light source, such as, for example, an LED bulb, an incandescent light bulb, a fluorescent light bulb, to name a few.

BACKGROUND INFORMATION

It is well known that mirrors have been used for many applications. These applications include, but not limited to, safety and easier viewing, seasonal lighting, decoration, arts, entertainment, personal grooming, to name a few. Some mirrors have a polished surface, while other use glass or similar material with a coating of some reflective material, such as, for example, thin layers of a metallic silver material. More recently a new inventive mirror has appeared in the market which uses a thin foil with a reflective coating. These thin foil mirrors are light weight and do not shatter like glass. These thin foil mirrors are finding new applications, such as, for example, in dance studios, ceiling mirrors, wall mirrors, personal grooming mirrors, to name a few.

U.S. Design Pat. No. D545,067 (James Vernon Mischel, Jr.), the entire disclosure of which is incorporated herein by reference, discloses a backlit mirror.

U.S. Design Pat. No. D545,574 (James Vernon Mischel, Jr.), the entire disclosure of which is incorporated herein by reference, discloses a backlit mirror.

U.S. Pat. No. 5,997,149 (Chia-Wu Chu), the entire disclosure of which is incorporated herein by reference, discloses a reversible, backlit grooming mirror has a planar mirror and a concave mirror mounted back-to-back in a reflector unit in parallel relation, with a space between the mirrors. The reflector unit is mounted for rotation in a mirror frame between a first position presenting the planar mirror to a user and a second position presenting the concave mirror to the user. A light source such as a halogen lamp is disposed in the space between the mirrors. A switch responsive to rotation of the reflector unit terminates electrical power to the lamp unless the reflector unit occupies a position in which one of the mirrors is in an operative position before the user.

U.S. Pat. No. 6,880,952 (Chris Kiraly, et al.), the entire disclosure of which is incorporated herein by reference, discloses a compact, energy-efficient extensible illumination source combines the reliability advantages of light emitting diodes (LEDs) with the brightness of conventional lighting. High reliability of the LEDs provides trouble-free operation over a long hour lifetime. This high-output light source can be used in direct lighting applications or for backlighting for translucent materials. The illumination source includes LED printed wire board segments that may be configured to form a light line of any length. The segments are mounted on a inner mounting base which also serves as a first stage heat sink for the LEDs. The illumination source includes a linear mirror for reflecting radiant energy away from the LEDs to produce a uniform linear illumination pattern. A window provides mechanical protection for the LEDs and may be used for diffusing or filtering light from the LEDs. An integral base in contact with the inner mounting base also serves as a heat sink and provides structural support for the illumination source. The integral base further includes channels and cavities for cooling the illumination source and for housing power cables.

U.S. Pat. No. 7,202,613 (Frederick M. Morgan, et al.), the entire disclosure of which is incorporated herein by reference, discloses lighting units of a variety of types and configurations, including linear lighting units suitable for lighting large spaces, such as building exteriors and interiors. Also provided in this invention are methods and systems for powering lighting units, controlling lighting units, authoring displays for lighting units, and addressing control data for lighting units.

U.S. Pat. No. 7,303,309 (Chen H. Wu, et al.), the entire disclosure of which is incorporated herein by reference, discloses a backlit sign with an LED module, with a housing that includes a top wall having a first length, a bottom wall having a second length, and a pair of opposing sidewalls each having a third length, wherein at least a portion of one of the sidewalls is translucent. One or more LED modules are mounted to the top wall and include a plurality of LEDs for producing light. The first, second and third lengths are selected to maximize illumination of the sidewalls by the produced light, and to minimize a width and weight of the sign. A mirror can be used to increase the reflectivity of the bottom wall.

U.S. Patent Publication No. 20060007701 (Volker Schoellmann, et al.), the entire disclosure of which is incorporated herein by reference, discloses a display device is described, which comprises a movable element (17) and selection means (15, 16) for locally bringing the movable element into contact with a selected one of two light guides (11, 12), arranged on either sides of the movable element. This provides an essentially symmetric display device, with one light guide on each side of the movable element. The display can display information in two directions, and the selection means can be controlled in a suitable way to activate selected portions of the guides. The invention can be used to provide a bi-directional display.

U.S. Patent Publication No. 20070195533 (Klaus Herbert Gunter Wenger), the entire disclosure of which is incorporated herein by reference, discloses a foil including optically refractive pyramidal elements, which each have a triangular base. The bases of adjacent elements are turned 180 degrees relative to each other. The foil has optically refractive characteristics upon incidence of electromagnetic waves thereon, which characteristics render the foil suitable for imparting a desired pattern, possibly in a desired direction, to the exiting waves. The pattern may be a uniform pattern, for example, so as to impart a uniform or diffuse light to electromagnetic waves, for example visible light, from a concentrated light source.

U.S. Patent Publication No. 20070291498 (Alexander Covasala, et al.), the entire disclosure of which is incorporated herein by reference, discloses an invention that relates to an electro-luminescent light element, and in particular to a foil-shaped light element with a light emitting surface (34) for emitting light from a light pigment layer (16) arranged on a carrier (12). According to the invention the light element (10) is provided with an electrically conductive cover (30).

U.S. Patent Publication No. 20080170309 (Jacek Helenowski), the entire disclosure of which is incorporated herein by reference, discloses a mirrored element (101) includes a first section (201) that is translucent when a backlight (301) is on and mirrored when the backlight is off (301). A second section (203) provides a mirrored surface when the backlight (301) is on and when the backlight (301) is off. The mirrored element (101) may optionally be provided with an enclosure (103). A baking process may be utilized to provide the second section (203) of the mirrored element (101).

Therefore there is a need for improvement in a foil mirror and in particular in a foil mirror with at least one back light.

Furthermore, this invention improves on the deficiencies of the prior art and provides an inventive foil mirror with at least one back light.

PURPOSES AND SUMMARY OF THE INVENTION

The invention is a novel foil mirror with at least one back light.

Therefore, one purpose of this invention is to provide a foil mirror with at least one back light.

Another purpose of this invention is to provide a foil mirror with at least one back light where the foil mirror does not shatter on impact.

Yet another purpose of this invention is to provide a foil mirror with at least one back light where foil mirror has a colored mirror finish.

Therefore, in one aspect this invention comprises a mirror apparatus comprising:

(a) a foil mirror comprising at least one first layer and at least one second layer, wherein said first layer comprises a flexible plastic material and said second layer comprises at least one coating of at least one reflective material, and forming said foil mirror;

(b) at least a portion of said foil mirror secured to at least one frame such that at least a portion of said coating of said at least one reflective material is in contact with said frame;

(c) at least one light source adjacent to said at least one coating of said at least one reflective material, and thereby forming said mirror apparatus.

In another aspect this invention comprises a mirror apparatus comprising:

(a) a foil mirror comprising at least one first layer and at least one second layer, wherein said first layer comprises a flexible plastic material and said second layer comprises at least one coating of at least one reflective material, and forming said foil mirror;

(b) at least a portion of said foil mirror secured to at least one backing material such that at least a portion of said coating of said at least one reflective material is in contact with at least a portion of said at least one backing material;

(c) at least one opening in said at least one backing material; and (d) at least one light source inside at least one opening in said at least one backing material, and wherein said light source is adjacent to said at least one coating of said at least one reflective material, and thereby forming said mirror apparatus.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

The foil mirror with back light or Mirrorlite or Mirrorlight (Pending Trademark of Hudson Mirror, LLC) is a glassless mirrored panel that with the operation of an electrical switch instantly becomes a light fixture. By using highly efficient light source to backlight the mirrored foil panel the electrical costs to light an area can be significantly reduced. The foil itself can be comprised of one or more layer or combinations of plastic, film or composite sheeting, and then assembled into at least one optical stack.

Figure 1:
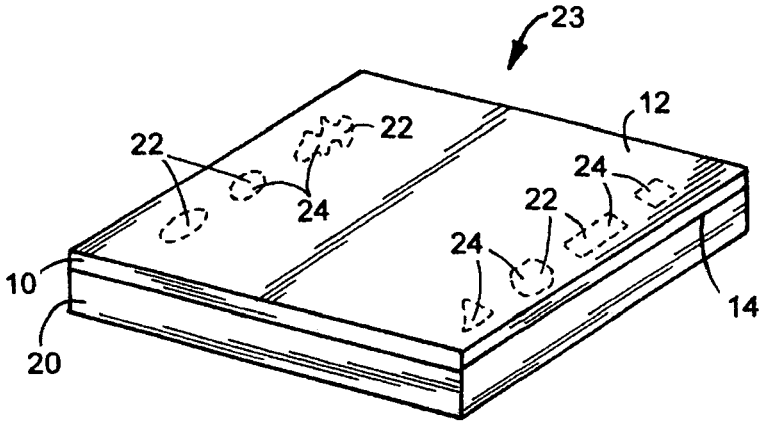
FIG. 1 illustrates a first embodiment of the foil mirror with back light of this invention.

FIG. 1 illustrates a first embodiment of the foil mirror with back light 23, or Mirrorlight 23, of this invention. The Mirrorlight 23, comprises at least one foil panel 10, that is secured to at least one fixture 20. The foil panel 10, has a first or upper or top surface 12, and a second or lower or bottom surface 14. The fixture 20, has at least one cavity or hole or opening 22, to accommodate at least one high intensity light 24.

Figure 2:
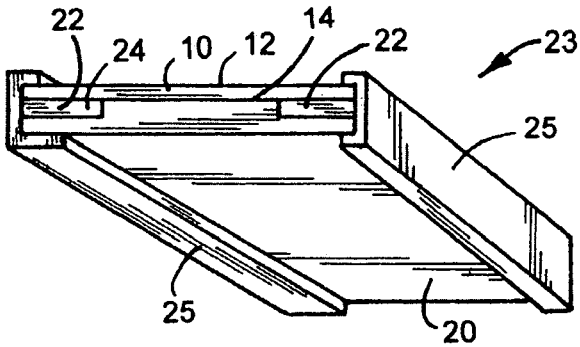
FIG. 2 is a detailed cut-away view of a second embodiment of the foil mirror with back light of this invention.

FIG. 2 is a detailed cut-away view of a second embodiment of the foil mirror with back light 23, or Mirrorlight 23, of this invention. As shown in FIG. 2, the Mirrorlight 23, comprises at least one frame or support 25, that is secured to at least a portion of the foil panel 10, and the fixture 20.

Figure 3:
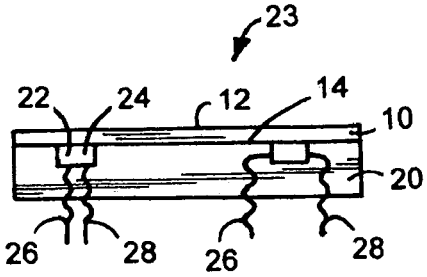
FIG. 3 is a detailed cut-away view of a third embodiment of the foil mirror with back light of this invention.

FIG. 3 is a detailed cut-away view of a third embodiment of the foil mirror with back light 23, or Mirrorlight 23, of this invention. As shown in FIG. 3, the mirrorlite 23, comprises a first wire 26, and a second wire 28, that connects to the high intensity light 24.

Figure 4:
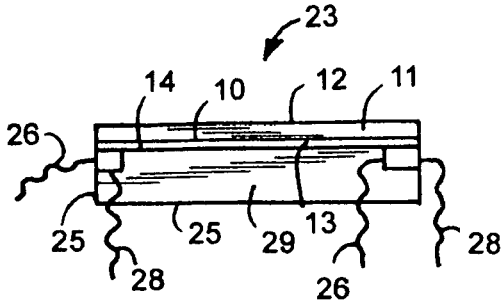
FIG. 4 is a detailed cut-away view of a fourth embodiment of the foil mirror with back light of this invention.

FIG. 4 is a detailed cut-away view of a fourth embodiment of the foil mirror with back light 23, or Mirrorlight 23, of this invention. As shown in FIG. 4, the Mirrorlight 23, has a frame or support 25, that is secured to at least a portion of the foil panel 10, and the area between the second surface 14, and the frame 25, is a hollow area or void area or empty space 29. The foil panel 10, basically comprises of at least two layers 11 and 13. The layer 11, is preferably at least one layer of at least one transparent material 11, while layer 13, is at least one layer of at least one coating of at least one reflective material 13.

Furthermore, FIG. 4 also illustrates a fifth embodiment of the foil mirror with back light 23, or Mirrorlight 23, of this invention. As shown in FIG. 4, the Mirrorlight 23, has a frame or support 25, that is secured to at least a portion of the foil panel 10, and the area between the second surface 14, and the frame 25, is a hollow area or void area or empty space 29. The foil panel 10, basically comprises of at least two layers 11 and 13. The layer 11, is preferably at least one layer of at least one transparent material 11, while layer 13, is at least one layer of at least one applied film or coating 13, to the reverse or the bottom side of the foil layer 11, such that when an external light which is projected towards the hollow area 29, of the foil mirror 10, results in an image or colored light projection that is visible at the first or upper or top surface 12.

The foil panel 10, is preferably made from a plastic material, it is flexible, and has at least one coating of a metallic material. The first surface 12, of the foil panel 10, once manufactured has a mirror-like finish. For most applications the mirror-like finish appears on at least a portion of the first surface 12, of the foil panel 10.

The shape of the opening 22, is selected from a group comprising, a square shape, a rectangular shape, a triangular shape, a circular shape, an elliptical shape, a polygonal shape, an odd shape, to name a few.

Several colored foil panels are available such as, gold, silver, bronze, to name a few. The glassless mirrored panel reflects an optical quality that is bright, free of distortion and equivalent to that of a first surface glass mirror.

The foil panels are lightweight, shatter proof, and easy to install. In a ceiling application additional sound reduction can be achieved by adding a sound absorbing panel over the mirrored foil panel.

Modular electrical installation makes electrical installation very easy. In ceilings the Mirrorlight can replace standard ceiling tiles and fluorescent lights.

The Mirrorlight is easy to clean and maintain, because the glassless mirrored surface is only one thousandth of an inch thick, and it has virtually no mass, and no static electricity to attract dust, and grime. If the foil panel should become dirty, it is easily cleaned using non-abrasive, non-fibrous cloth and any common household non-abrasive cleaning solution.

For some application at least one small pass-through hole could be made in the backing material so that when the Mirrorlight is going through a heat adhesive process the at least one small hole allows for any trapped air to escape while the mirror foil is being stretched and adhered to the backing material and/or the frame.

For some applications at least one backing material 20, 25, could be secured to at least a portion of the at least one coating of at least one reflective material, and wherein the backing material could be selected from a group comprising a foam material, a cloth material, a cardboard material, a composite material, a sponge-type material, to name a few.

It is preferred that the at least one light source 24, is selected from a group comprising of an LED bulb, an incandescent light bulb, a fluorescent light bulb, a sodium light bulb, a mercury light bulb, to name a few.

The thickness of said foil mirror could be between about 0.006 mm to about 0.3 mm, and preferably between about 0.10 mm to about 0.25 mm, and more preferably between about 0.15 mm to about 0.2 mm.

It is preferred that the foil mirror 10, has a high reflectivity. For some applications the light reflectivity could be between about 65 percent to about 99.9 percent, and preferably between about 75 percent to about 95 percent, and more preferably between about 85 percent to about 92 percent.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A mirror apparatus comprising:

(a) a foil mirror comprising at least one first layer and at least one second layer, wherein said first layer comprises a flexible plastic material and said second layer comprises at least one coating of at least one reflective material, and forming said foil mirror;

(b) at least a portion of said foil mirror secured to at least one frame such that at least a portion of said coating of said at least one reflective material is in contact with said frame;

(c) at least one light source adjacent to said at least one coating of said at least one reflective material, and wherein at least one backing material is secured to at least a portion of said at least one coating of at least one reflective material, and wherein said backing material has at least one hole for the passage of air, and thereby forming said mirror apparatus.

2. The mirror apparatus of claim 1, wherein said at least one light source is secured to at least a portion of said frame.

3. The mirror apparatus of claim 1, wherein said backing material is selected from a group consisting of a foam material, a cloth material, a cardboard material, a composite material, and a sponge-type material.

4. The mirror apparatus of claim 1, wherein the color of said at least one coating of at least one reflective material is selected from a group consisting of gold color, silver color, and bronze color.

5. The mirror apparatus of claim 1, wherein said at least one light source is selected from a group consisting of an LED bulb, an incandescent light bulb, a fluorescent light bulb, a sodium light bulb, and a mercury light bulb.

6. The mirror apparatus of claim 1, wherein said at least one light source is inserted into at least one opening in at least one material secured to said foil mirror.

7. The mirror apparatus of claim 1, wherein said at least one light source is inserted into at least one opening in at least one material secured to said foil mirror, and wherein the shape of said at least one opening is selected from a group consisting of a square shape, a rectangular shape, a triangular shape, a circular shape, an elliptical shape, a polygonal shape, and an odd shape.

8. The mirror apparatus of claim 1, wherein the thickness of said foil mirror is between about 0.006 mm to about 0.3 mm, and preferably between about 0.10 mm to about 0.25 mm, and more preferably between about 0.15 mm to about 0.2 mm.

9. The mirror apparatus of claim 1, wherein said foil mirror has a light reflectivity of between about 65 percent to about 99.9 percent, and preferably between about 75 percent to about 95 percent, and more preferably between about 85 percent to about 92 percent.

10. A mirror apparatus comprising:

(a) a foil mirror comprising at least one first layer and at least one second layer, wherein said first layer comprises a flexible plastic material and said second layer comprises at least one coating of at least one reflective material, and forming said foil mirror;

(b) at least a portion of said foil mirror secured to at least one backing material such that at least a portion of said coating of said at least one reflective material is in contact with at least a portion of said at least one backing material;

(c) at least one opening in said at least one backing material; and (d) at least one light source inside at least one opening in said at least one backing material, and wherein said light source is adjacent to said at least one coating of said at least one reflective material, and thereby forming said mirror apparatus.

11. The mirror apparatus of claim 10, wherein said at least one light source is secured to at least a portion of at least one frame.

12. The mirror apparatus of claim 10, wherein said at least one backing material is secured to at least a portion of said at least one coating of at least one reflective material.

13. The mirror apparatus of claim 10, wherein said at least one backing material is secured to at least a portion of said at least one coating of at least one reflective material, and wherein said backing material has at least one hole for the passage of air.

14. The mirror apparatus of claim 10, wherein said at least one backing material is secured to at least a portion of said at least one coating of at least one reflective material, and wherein said backing material is selected from a group consisting of a foam material, a cloth material, a cardboard material, a composite material, and a sponge-type material.

15. The mirror apparatus of claim 10, wherein the color of said at least one coating of at least one reflective material is selected from a group consisting of gold color, silver color, and bronze color.

16. The mirror apparatus of claim 10, wherein said at least one light source is selected from a group consisting of an LED bulb, an incandescent light bulb, a fluorescent light bulb, a sodium light bulb, and a mercury light bulb.

17. The mirror apparatus of claim 10, wherein said at least one light source is inserted into at least one opening in at least one material secured to said foil mirror.

18. The mirror apparatus of claim 10, wherein said at least one light source is inserted into at least one opening in at least one material secured to said foil mirror, and wherein the shape of said at least one opening is selected from a group consisting of a square shape, a rectangular shape, a triangular shape, a circular shape, an elliptical shape, a polygonal shape, and an odd shape.

19. The mirror apparatus of claim 10, wherein the thickness of said foil mirror is between about 0.006 mm to about 0.3 mm, and preferably between about 0.10 mm to about 0.25 mm, and more preferably between about 0.15 mm to about 0.2 mm.

20. The mirror apparatus of claim 10, wherein said foil mirror has a light reflectivity of between about 65 percent to about 99.9 percent, and preferably between about 75 percent to about 95 percent, and more preferably between about 85 percent to about 92 percent.

* * * * *